US006725947B2

(12) United States Patent
Palaschenko et al.

(10) Patent No.: US 6,725,947 B2
(45) Date of Patent: Apr. 27, 2004

(54) ROLLER BITS WITH BEARING FAILURE INDICATION, AND RELATED METHODS, SYSTEMS, AND METHODS OF MANUFACTURING

(75) Inventors: Yuri A. Palaschenko, Dallas, TX (US); Raul A. Miglierini, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/934,075

(22) Filed: Aug. 21, 2001

(65) Prior Publication Data

US 2002/0092679 A1 Jul. 18, 2002

Related U.S. Application Data

(60) Provisional application No. 60/226,764, filed on Aug. 21, 2000.

(51) Int. Cl.[7] ..... E21B 12/02
(52) U.S. Cl. ..... 175/39; 175/339; 175/371
(58) Field of Search ..... 175/39, 339, 371, 175/331, 327

(56) References Cited

U.S. PATENT DOCUMENTS 3,011,566 A * 12/1961 Graham ..... 175/39
3,363,702 A * 1/1968 Bielstein ..... 175/39
3,578,092 A * 5/1971 Tesch et al. ..... 175/39
3,678,883 A * 7/1972 Fischer ..... 116/208
4,436,164 A * 3/1984 Garner ..... 175/39
4,655,300 A * 4/1987 Davis et al. ..... 173/39
4,730,681 A * 3/1988 Estes ..... 175/39
4,785,894 A * 11/1988 Davis et al. ..... 175/39
4,785,895 A * 11/1988 Davis et al. ..... 175/39
4,911,252 A * 3/1990 Estes ..... 175/39

* cited by examiner

*Primary Examiner*—David Bagnell
*Assistant Examiner*—Daniel Stephenson
(74) *Attorney, Agent, or Firm*—Robert O. Groover

(57) ABSTRACT

A rotary drill bit includes a bit body that includes a plurality of upright legs that terminate in an exterior bearing surface. At least one roller cutter is affixed to a corresponding exterior bearing surface of one of the plurality of legs. The roller cutter has an exterior cutting surface and a base edge and defines an interior bearing surface that is complementary to a corresponding exterior bearing surface. At least one duct is defined by the lower surface of the lateral wall and is adjacent to at least one exterior bearing surface. A plug is disposed in the duct at a distance from the base edge one of the roller cutters so that if either the interior bearing surface or the exterior bearing surface wears beyond a threshold, the plug will cause a remotely-sensible indication of excessive bearing wear to be asserted.

13 Claims, 4 Drawing Sheets

ROLLER BITS WITH BEARING FAILURE INDICATION, AND RELATED METHODS, SYSTEMS, AND METHODS OF MANUFACTURING

CROSS REFERENCE TO A PROVISIONAL APPLICATION

This patent application claims priority from Provisional Application Ser. No. 60/226,764, filed on Aug. 21, 2000, the entirety of which is hereby incorporated by reference.

BACKGROUND OF THE INVENTION

1. Field of the Invention

The present invention relates to a sealed bearing roller cutter-type rotary drill bit used to drill oil and gas wells in the earth, and more particularly to such a bit having a bearing failure indicator feature.

2. Description of the Prior Art

Rotary drill bits of the roller cutter type, for example as disclosed in U.S. Pat. No. 3,923,348, (incorporated herein by reference) are the most commonly used type of drill bits in the oil and gas well drilling industry because they offer satisfactory rates of penetration and useful lives in drilling most commonly encountered formations. Roller cutter drill bits include a bit body having a threaded pin at its upper end adapted to be detachably secured to a drill string suspended from a drill rig, and a plurality of depending legs, typically three such legs, at its lower end. The drill bit further includes a plurality of conical roller cutters having cutting elements thereon, one for each leg, and a bearing rotatably mounting each roller cutter on its respective leg.

Sealed bearing type roller cutter bits further have a lubrication system including a reservoir holding a supply of lubricant. A passage in the bit body extends from the reservoir to the bearing to allow flow of lubricant to the bearing. A seal is disposed between the roller cutter and the bearing journal to hold lubricant in the bit. A diaphragm at the reservoir provides pressure compensation between the lubricant and the drilling fluid in the annulus between the bit and the well bore.

In use, roller cutter drill bits are rotated in the well bore on the end of a drill string which applies a relatively high downward force thereto. As the bits are rotated, the conical roller cutters rotate on the bearing journals, thereby bringing the cutting elements into engagement with the rock at the bottom of the well bore. The cutting elements drill the rock at the well bore bottom by applying high point loads to the rock, thereby causing it to crack or fracture in compression.

For most cost effective drilling, a worn drill bit should be replaced when the increased cost due to the worn bit's reduced rate of drilling penetration, as compared to that of a new bit, becomes equal to the cost of replacing the bit (i.e., the cost of the new bit plus the cost of rig time in tripping the drill string in and out of the well bore). Unfortunately, once a drill bit is positioned in a well bore, it becomes hard to gather reliable information regarding its operating condition, its performance and its remaining useful life. Typically, the decision by a rig operator to replace a drill bit is a subjective one, based on experience and offset data showing the performance of similar bits in drilling similar formations. However, because of the many factors affecting drilling performance, besides the condition and performance of the bit itself, the rig operator's decision as to when to replace a bit may not be correct.

The rig operator may unknowingly run the bit so long that it fails. Bit failure may also result from an improper application of the bit, such as by excessive weight on the bit, excessive rotational speed and drilling in the wrong kind of bit for the type of rock being drilled, or even from a defect in the bit itself. Bit failures typically occur in one of two modes: (1) breakage of the cutting elements, or (2) bearing failure. While the first mode is more common, the second may be more serious. In the first mode, pieces of the cutting elements, which are either steel teeth or tungsten carbide inserts, are broken from the roller cutters. This breakage significantly reduces the rate of drilling penetration, but the broken pieces are typically carried away from the well bore bottom by the circulating drilling fluid thereby leaving the well bore bottom clean for a replacement bit. In contrast, if the bit is continued to be used with a failed bearing assembly, the assembly will no longer be able to hold the roller cutter on the bearing journal and the roller cutter will fall from the bit when the drill string is pulled from the well bore. A lost roller cutter can be retrieved from the well bore bottom only by a time-consuming and expensive "fishing" operation, in which a special retrieval tool is tripped in and out of the well bore. In sealed bearing roller cutter bits, bearing failure is often the result of a seal failure which allows lubricant to flow out of the bit and drilling fluid, having abrasive particles entrained therein, to flow in. Although less common, diaphragm failure has the same result as seal failure. In any event, bearing failure is almost always preceded by or at least accompanied by a loss of lubricant.

Numerous bearing failure indicator systems have been proposed for inclusion in drill bits so as to give the rig operator a signal indicating bearing failure. One such system involves measurement and interpretation of certain drilling parameters at the drill rig, such as drill string torque, weight on bit, and rate of penetration, to signal drill bit bearing failure. In practice this system has proved to be unreliable.

From the foregoing it can be seen that there is a need for an apparatus that reliably detects bearing failure in roller cutter type rotary drill bits.

SUMMARY OF THE INVENTION

The disadvantages of the prior art are overcome by the present invention which, in one aspect, is a rotary drill bit for attachment to a drill string defining a drilling fluid chamber. The rotary drill bit includes a bit body, at least one roller cutter, at least one duct and at least one plug. The bit body includes a top collar that facilitates attachment of the bit body to a drill string and a plurality of upright legs depending downwardly from the collar. Each of the plurality of legs is connected to a lateral wall, having an upper surface and an opposite lower surface, that separates the drilling fluid chamber from a lower open region defined by the lower surface. At least one of the plurality of legs terminates in an exterior bearing surface. The roller cutter is affixed to a corresponding exterior bearing surface of at least one of the plurality of legs and has an exterior cutting surface and a base edge. The roller cutter defines an interior bearing surface that is complementary to a corresponding exterior bearing surface of the leg and that opens to the base edge. At least one duct is defined by lower surface of the lateral wall and is adjacent to at least one exterior bearing surface. A plug, at least a portion of which is disposed in a portion of the duct, is disposed from the base edge one of the roller cutters at a distance so that if either the interior bearing surface or the exterior bearing surface wears beyond a predetermined threshold, the plug will cause a remotely-sensible indication of excessive bearing wear to be asserted.

In another aspect, the invention is a rotary drill bit for attachment to a drill string that defines a drilling fluid chamber. The rotary drill bit includes a bit body, a plurality of roller cutters each affixed to the bit body by a bearing, a plurality of ducts that communicate between the drilling fluid chamber and a lower open region and a plurality of brittle plugs that seal the ducts unless a bearing has worn beyond a threshold. The bit body includes a top collar that facilitates attachment of the bit body to a drill string and a plurality of upright legs depending downwardly from the collar. Each of the plurality of legs is connected to a lateral wall, having an upper surface and an opposite lower surface, that separates the drilling fluid chamber from a lower open region defined by the lower surface. Each of the plurality of legs terminates in an exterior bearing surface. The roller cutters are each affixed to a corresponding exterior bearing surface of a different one of the plurality of legs. Each roller cutter has an exterior cutting surface and a base edge, and defines an interior bearing surface that is complementary to a corresponding exterior bearing surface of at least one of the legs and that opens to the base edge. Each of the ducts is defined by the bit body and each duct opens to the upper surface of the lateral wall and to the lower open region adjacent each one of the legs. Each duct includes a first bore extending downwardly from the upper surface of the lateral wall and opening to the drilling fluid chamber. A second bore, having an open end, extends inwardly from the lower surface of the lateral wall from the open end and opens to the lower open region. The second bore intersects the first bore so that the lower open region is in fluid communication with the drilling fluid chamber.

The brittle plugs are typically hollow tungsten carbide shale burn inserts that seal each of the ducts from the lower open region adjacent the open end of the second bore. Each brittle plug is disposed adjacent the base edge of a different one of the roller cutters at a distance from the base edge so that if either the interior bearing surface or the exterior bearing surface wears beyond a predetermined threshold, the base edge will cause the brittle plug to allow drilling fluid to pass therethrough, thereby causing a drop in drilling fluid pressure in the drilling fluid chamber.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1A:
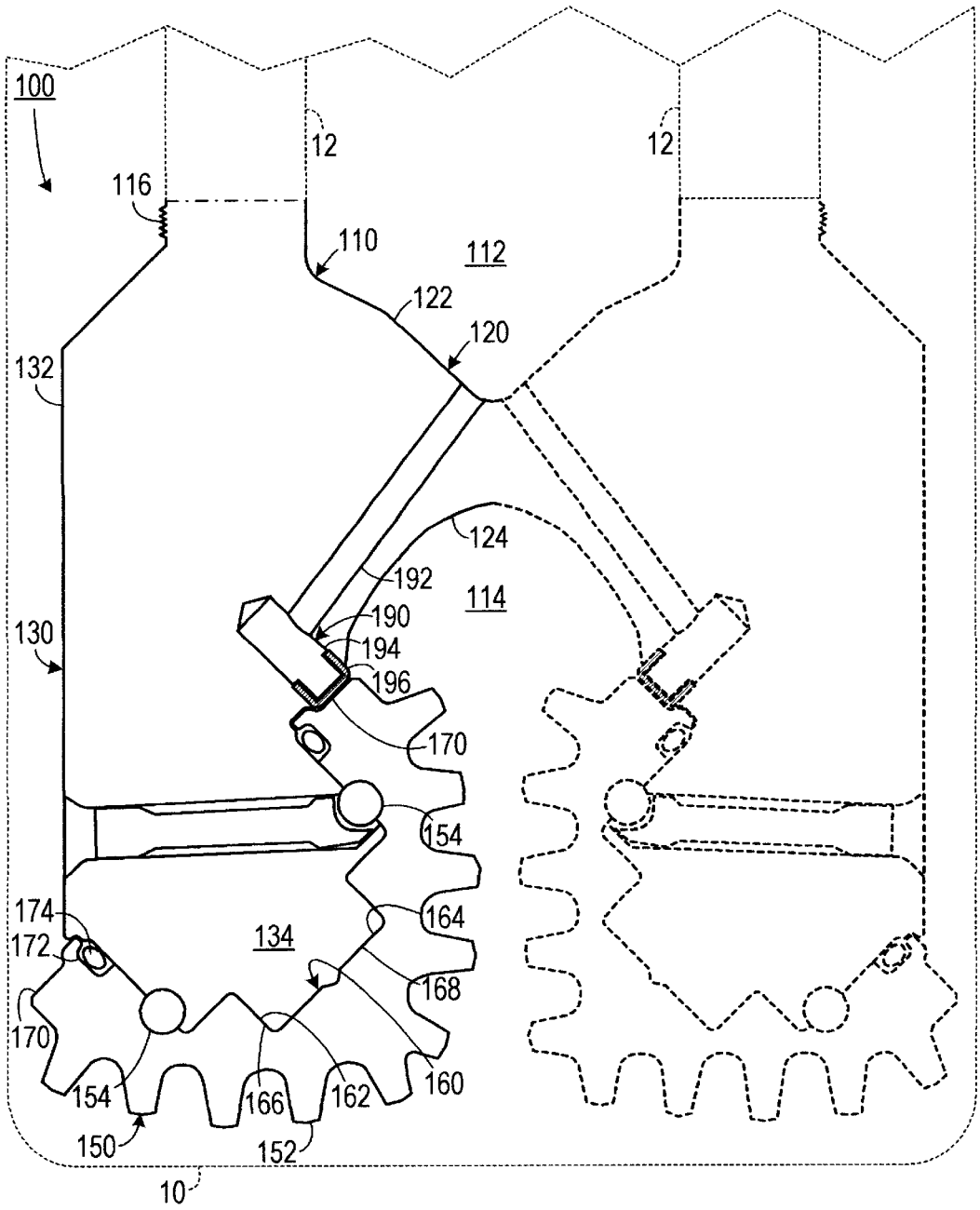
FIG. 1A a cross-sectional view of a rotary bit according to one aspect of the invention.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

As shown in FIG. 1A, one illustrative embodiment of a roller bit 100 employing the invention includes a bit body 110 that has a collar 116 that is affixable to a drill string 12 (not shown), typically by threading, and a plurality of legs 130 depending downwardly therefrom, each leg 130 having an exterior surface 132. A lateral wall 120, having an upper surface 122 and an opposite lower surface 124, connects the legs 130. The upper surface 122 and the interior of the drill string (not shown) defines a drilling fluid chamber 112, through which drilling fluid (such as a drilling mud) is pumped to carry away drilling detritus during the drilling process. The lower surface 124 defines a lower open region 114 that is open to the hole 10 being bored.

Each of the legs terminates in an exterior bearing surface 134 and a roller cutter 150 is applied thereto. The exterior bearing surface 134 typically includes an exterior thrust bearing 168 and an exterior journal bearing 166. A ball bearing/bearing race assembly 154 is also typically provided. The roller cutter 150, which terminates in a peripheral edge 170, has an exterior surface adapted for cutting the underlying formation and includes a plurality of teeth 152. An interior bearing surface 160, that is complementary in shape to the exterior bearing surface 134, is defined by the roller cutter 150. The interior bearing surface 160 includes an interior journal bearing surface 162 and an interior thrust bearing surface 164. The bearing surfaces 134 and 160 are typically include a lubricant and are sealed with a recess 172 and o-ring 174 assembly to keep contaminants away from the lubricant.

The bit 100 includes a bearing wear sensor that causes a detectable drop in drilling fluid pressure when the bearing surfaces 134 or 160 show excessive wear. The bearing wear sensor includes a duct 190, which in this embodiment has a first bore 192 that opens to the drilling fluid chamber 112. A second bore 194, that opens to the lower open region 114, intersects the first bore 192. A brittle plug 196, typically made from tungsten carbide, prevents leakage of the drilling fluid from the second bore 194 into the lower open region 114. The brittle plug 196 is disposed adjacent the edge 170 of the roller cutter 150.

Figure 1B:
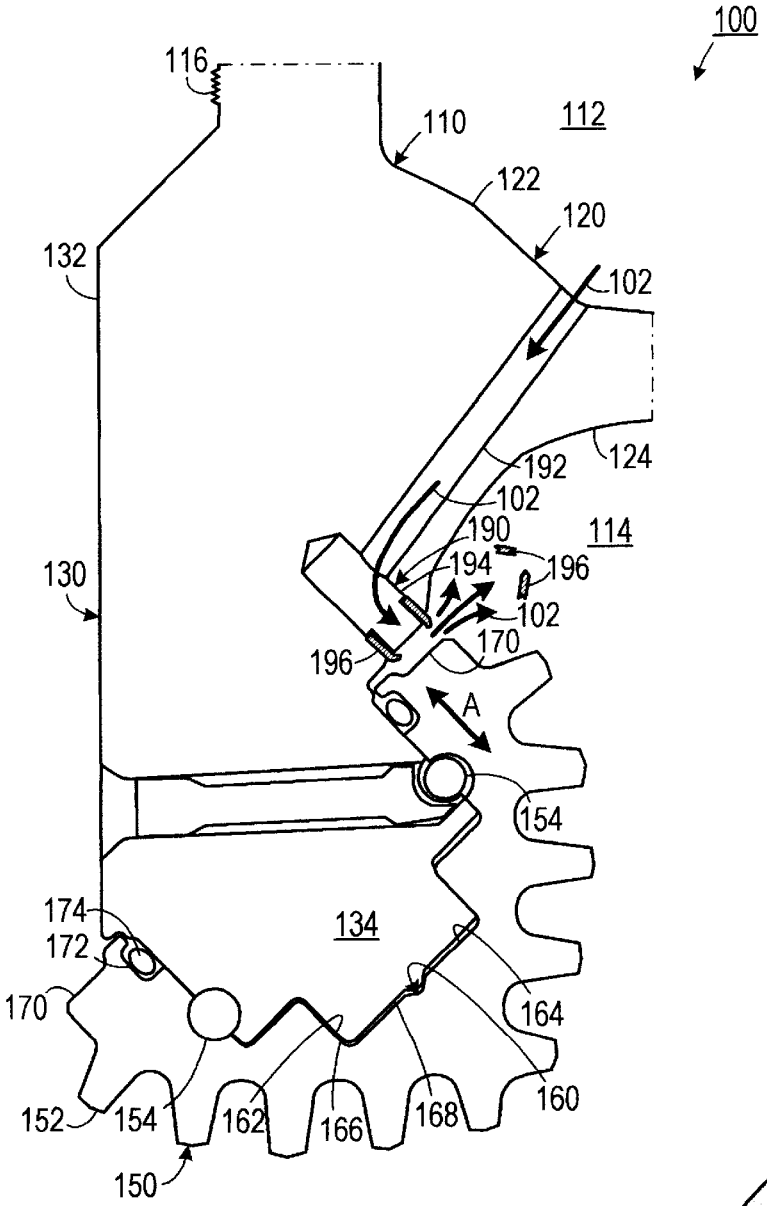
FIG. 1B is a cross-sectional view of one leg of the bit shown in FIG. 1, demonstrating a worn bearing.

As shown in FIG. 1B, when the bearing surfaces 134 and 160 wear excessively, the roller cutter 150 will begin to oscillate along arrow A and eventually begin abrading the brittle plug 196. Eventually, the brittle plug 196 will break apart and allow drilling fluid 102 to flow out of the drilling fluid chamber 112 through the first bore 192 and the second bore 194 into the lower open region 114. This loss of drilling fluid 102 into the lower open region 114 causes a detectable drop in drilling fluid pressure in the drilling fluid chamber 112, which indicates that a bearing failure is approaching and that the bit 100 should be replaced.

Figure 1C:
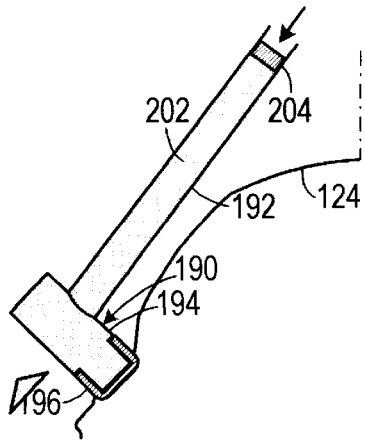
FIG. 1C is a cross-sectional view of a duct holding a traceable fluid.

As shown in FIG. 1C, a stopper 204 may plug a portion of the duct 190 and a tracing fluid 202 may be placed therein. In this embodiment, when the plug 196 breaks open, the tracing fluid 202 is released into the drilling fluid and is, thus, detectable at the surface. The tracing fluid 202 should be made of a material that is detectable even if diluted by drilling fluid.

Figure 2:
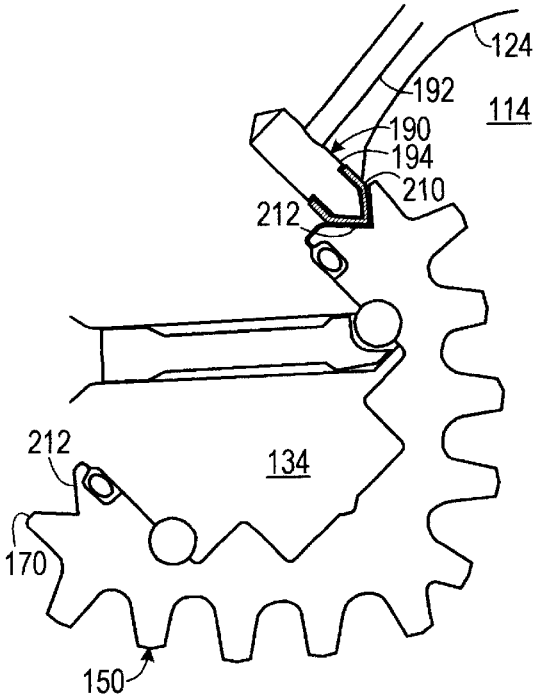
FIG. 2 is a cross-sectional view of a portion of a rotary bit having a plug extending into an angular groove.

As shown in FIG. 2, the peripheral edge 170 of the roller cutter 150 could define a groove 212. A plug 210 shaped complementary to the groove 212 could be used to seal the duct 190. This embodiment offers an advantage in that lateral movement of the roller cutter 150 will cause the plug 210 to break.

Figure 3A:
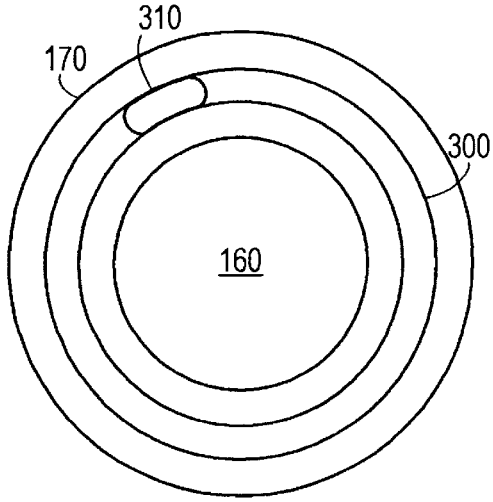
FIG. 3A is a plan view of a roller cutter including groove with a notch disposed therein.
Figure 3B:
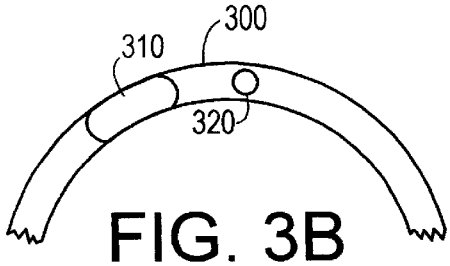
FIG. 3B is a detail of the groove with a plug disposed therein.
Figure 3C:
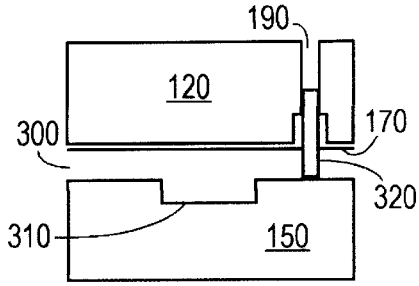
FIG. 3C is a cross-sectional view of an embodiment of the invention showing a plug that has not fallen into a notch.
Figure 3D:
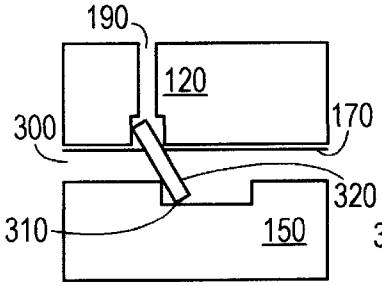
FIG. 3D is a cross-sectional view of an embodiment of the invention showing a plug that has fallen into a notch.
Figure 3E:
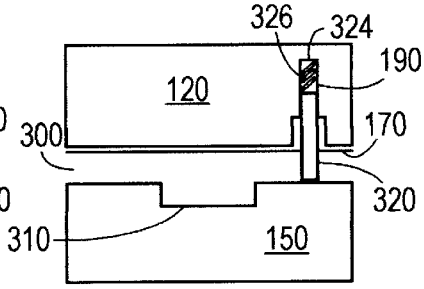
FIG. 3E is a cross-sectional view of an embodiment of the invention showing a spring-loaded plug.

As shown in FIGS. 3A through 3E, the groove 300 can define a notch 310 and the plug can comprises a solid pin 320 that is press fit into the duct 190. Movement of the rotary cutter 150 causes the pin 320 to be released from the duct 190 and fall into the slot 310. This causes the rotary cutter 150 to become locked and thereby causes an increase in drill string torque that can be detected on the surface. The duct 190 can be open to the drilling fluid chamber, as shown in FIG. 3D, in which case release of the pin 320 also causes a detectable decrease in drilling fluid pressure. In another embodiment, as shown in FIG. 3E, the duct 190 does not connect to the drilling fluid chamber but forms a blind hole 324 instead. In this case, a spring 326 is disposed in the hole 324 and loads the pin 320.

Figure 4:
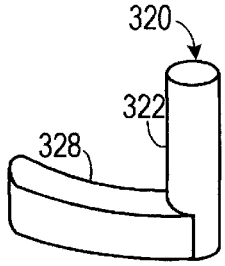
FIG. 4 is top perspective view of one embodiment of a plug.

One embodiment of a pin 320 used to lock the rotary cutter is shown in FIG. 4. This embodiment includes a bottom portion 328, that has a shape that is complementary to the slot, and a pin portion 322 extending upwardly therefrom.

Figure 5A:
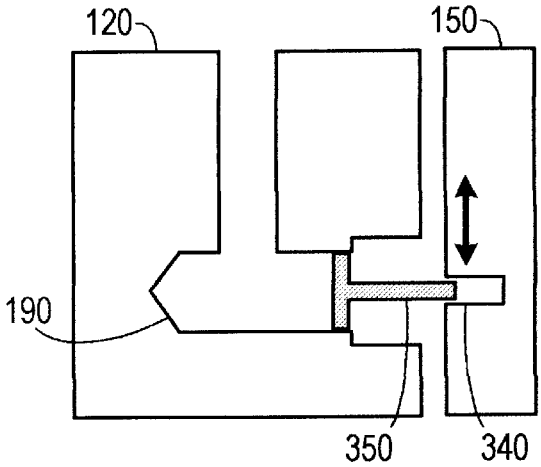
FIG. 5A is cross-sectional view of one embodiment of the invention in which a plug that is press fit into a duct.
Figure 5B:
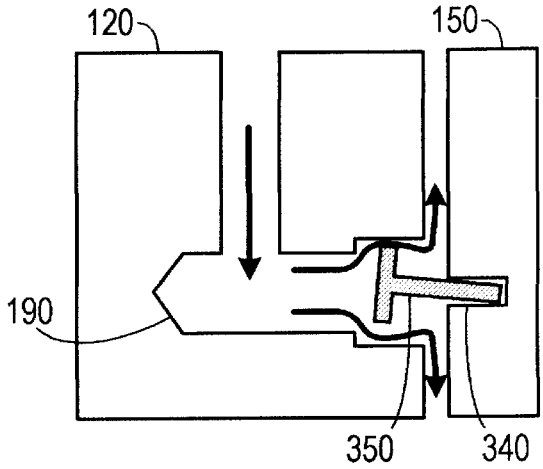
FIG. 5B is cross-sectional view of the embodiment shown in FIG. 5A, in which the plug has been released from a duct.
Figure 5C:
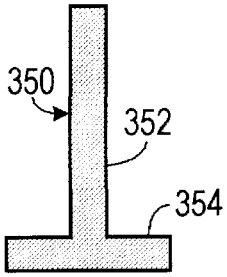
FIG. 5C is detailed cross-sectional view of the embodiment of the plug shown in FIG. 5A.

In another embodiment, as shown in FIGS. 5A through 5C, the plug 350 includes a disk portion 354 that is shaped to be press fit into a portion of the duct 190 and a rod portion 352 that extends from the disk portion 354. The rod portion 352 is shaped to extend into a portion of the groove 340. The rod portion 352 and the disk portion 354 could be made of the same material, for example steel. In another embodiment, the rod portion 352 and the disk portion 354 are made of different materials. In one example, the rod portion 352 is made of steel, while the disk portion 354 has a cast iron rim.

The above described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. A rotary drill bit for attachment to a drill string defining a drilling fluid chamber, the rotary drill bit comprising:

a. a bit body that includes a top collar that facilitates attachment of the bit body to a drill string, the bit body including a plurality of upright legs depending downwardly from the collar, each of the plurality of legs connected to a lateral wall, having an upper surface and an opposite lower surface, that separates the drilling fluid chamber from a lower open region defined by the lower surface, at least one of the plurality of legs terminating in an exterior bearing surface;

b. at least one roller cutter, affixed to a corresponding exterior bearing surface of at least one of the plurality of legs, the roller cutter having an exterior cutting surface and a base edge, the roller cutter defining an interior bearing surface that is complementary to a corresponding exterior bearing surface of the leg and that opens to the base edge;

c. at least one duct, defined by lower surface of the lateral wall and adjacent to at least one exterior bearing surface;

d. at least one plug, at least a portion of which is disposed in a portion of the duct, and disposed from the base edge one of the roller cutters at a distance so that if either the interior bearing surface or the exterior bearing surface wears beyond a predetermined threshold the plug will cause a remotely-sensible indication of excessive bearing wear to be asserted;

wherein the remotely-sensible indication comprises in increase in drill string torque.

2. The rotary drill bit of claim 1, further comprising a circular groove defined by the base edge of at least one of the roller cutters, wherein the plug has a shape that allows a portion of the plug to extend into a portion of the circular groove so that lateral motion of the roller cutter will cause the plug to assert the remotely-sensible indication of excessive bearing wear.

3. The rotary drill bit of claim 2, wherein the groove defines a slot and wherein the plug comprises a member that is press fit into the duct and shaped so that in the event of excessive bearing wear, a first portion of the plug is forced into the slot and a second portion of the plug remains in a portion of the duct, thereby inhibiting rotary motion of the roller cutter and causing an increase in drill string torque.

4. The rotary drill bit of claim 3, further comprising a spring, disposed in the duct that forces the plug into the slot when the plug is disturbed.

5. The rotary drill bit of claim 3, wherein a bottom portion of the plug has a shape that is complementary to the slot.

6. The rotary drill bit of claim 2, wherein the plug comprises:

a. a disk portion that is shaped to be press fit into a portion of the duct; and b. a rod portion extending from the disk portion and shaped to extend into a portion of the groove.

7. A rotary drill bit for attachment to a drill string defining a drilling fluid chamber, the rotary drill bit comprising:

a. a bit body that includes a top collar that facilitates attachment of the bit body to a drill string, the bit body including a plurality of upright legs depending downwardly from the collar, each of the plurality of legs connected to a lateral wall, having an upper surface and an opposite lower surface, that separates the drilling fluid chamber from a lower open region defined by the lower surface, at least one of the plurality of legs terminating in an exterior bearing surface;

b. at least one roller cutter, affixed to a corresponding exterior bearing surface of at least one of the plurality of legs, the roller cutter having an exterior cutting surface and a base edge, the roller cutter defining an interior bearing surface that is complementary to a corresponding exterior bearing surface of the leg and that opens to the base edge;

c. at least one duct, defined by lower surface of the lateral wall and adjacent to at least one exterior bearing surface;

d. at least one plug, at least a portion of which is disposed in a portion of the duct, and disposed from the base edge one of the roller cutters at a distance so that if either the interior bearing surface or the exterior bearing surface wears beyond a predetermined threshold the plug will cause a remotely-sensible indication of excessive bearing wear to be asserted;

wherein the remotely-sensible indication comprises an introduction of a traceable fluid into the drilling fluid.

8. A rotary drill bit for attachment to a drill string defining a drilling fluid chamber, the rotary drill bit comprising:

a. a bit body that includes a top collar that facilitates attachment of the bit body to a drill string, the bit body including a plurality of upright legs depending downwardly from the collar, each of the plurality of legs connected to a lateral wall, having an upper surface and an opposite lower surface, that separates the drilling fluid chamber from a lower open region defined by the lower surface, at least one of the plurality of legs terminating in an exterior bearing surface;

b. at least one roller cutter, affixed to a corresponding exterior bearing surface of at least one of the plurality of legs, the roller cutter having an exterior cutting surface and a base edge, the roller cutter defining an interior bearing surface that is complementary to a corresponding exterior bearing surface of the leg and that opens to the base edge;

c. at least one duct, defined by lower surface of the lateral wall and adjacent to at least one exterior bearing surface;

d. at least one plug, at least a portion of which is disposed in a portion of the duct, and disposed from the base edge one of the roller cutters at a distance so that if either the interior bearing surface or the exterior bearing surface wears beyond a predetermined threshold the plug will cause a remotely-sensible indication of excessive bearing wear to be asserted;

wherein the duct is defined by the bit body and opening to the upper surface of the lateral wall and to the lower open region adjacent at least one of the legs; and wherein the plug seals the duct from the lower open region so that when the interior bearing surface or the exterior bearing surface wears beyond the predetermined threshold, the base edge will cause the plug to allow drilling fluid to pass therethrough, thereby causing a drop in drilling fluid pressure in the drilling fluid chamber.

9. The rotary drill bit of claim 8, wherein the plug is brittle and comprises tungsten carbide.

10. The rotary drill bit of claim 8, wherein the plug is brittle and comprises a hollow tungsten carbide shale burn insert.

11. The rotary drill bit of claim 8, wherein the duct comprises:

a. a first bore extending downwardly from the upper surface of the lateral wall and opening to the drilling fluid chamber; and b. a second bore having an open end, extending inwardly from the lower surface of the lateral wall from the open end, which opens to the lower open region, the second bore intersecting the first bore so that the lower open region is in fluid communication with the drilling fluid chamber unless the plug is disposed so as to plug the open end.

12. The rotary drill bit of claim 8, further comprising:

a. a tracer fluid, comprising a material that is detectably different from the drilling fluid, that is disposed in a portion of the first duct; and b. a stopper disposed in the duct that separates the tracer fluid from the drilling fluid chamber, the stopper fit into the duct so that if the plug sealing the duct ceases to seal the duct, the stopper is forced toward the lower surface, thereby causing the tracer fluid to be forced into the lower open region to allow subsequent detection of the tracer fluid.

13. A rotary drill bit for attachment to a drill string defining a drilling fluid chamber, the rotary drill bit comprising:

a. a bit body that includes a top collar that facilitates attachment of the bit body to a drill string, the bit body including a plurality of upright legs depending downwardly from the collar, each of the plurality of legs connected to a lateral wall, having an upper surface and an opposite lower surface, that separates the drilling fluid chamber from a lower open region defined by the lower surface, each of the plurality of legs terminating in an exterior bearing surface;

b. a plurality of roller cutters, each affixed to a corresponding exterior bearing surface of a different one of the plurality of legs, each roller cutter having an exterior cutting surface and a base edge, each roller cutter defining an interior bearing surface that is complementary to a corresponding exterior bearing surface of at least one of the legs and that opens to the base edge;

c. a plurality of ducts, each duct defined by the bit body and each duct opening to the upper surface of the lateral wall and to the lower open region adjacent each one of the legs each duct including a first bore extending downwardly from the upper surface of the lateral wall and opening to the drilling fluid chamber and a second bore having an open end, extending inwardly from the lower surface of the lateral wall from the open end, which opens to the lower open region, the second bore intersecting the first bore so that the lower open region is in fluid communication with the drilling fluid chamber; and d. a plurality of hollow tungsten carbide shale burn insert brittle plugs that seal each of the ducts from the lower open region adjacent the open end of the second bore, each brittle plug being disposed adjacent the base edge of a different one of the roller cutters at a distance from the base edge so that if either the interior bearing surface or the exterior bearing surface wears beyond a predetermined threshold, the base edge will cause the brittle plug to allow drilling fluid to pass therethrough, thereby causing a drop in drilling fluid pressure in the drilling fluid chamber.

* * * * *